US005842608A

United States Patent [19]

Buchler

[11] Patent Number: 5,842,608

[45] Date of Patent: Dec. 1, 1998

[54] DISPENSER FOR LIQUID DISINFECTANTS, SURFACTANTS, AND THE LIKE

[76] Inventor: Rainer Buchler, Hulscheiderstrasse 11, D-53773 Hennef, Germany

[21] Appl. No.: 602,744

[22] PCT Filed: Aug. 18, 1994

[86] PCT No.: PCT/DE94/00958

§ 371 Date: Feb. 20, 1996

§ 102(e) Date: Feb. 20, 1996

[87] PCT Pub. No.: WO95/05110

PCT Pub. Date: Feb. 23, 1995

[30] Foreign Application Priority Data

Aug. 19, 1993 [DE] Germany ..... 93 12 397.3 U

[51] Int. Cl.[6] ..... B67D 5/06

[52] U.S. Cl. ..... 222/181.3; 222/341

[58] Field of Search ..... 222/129, 181.2, 222/181.3, 185.1, 341

[56] References Cited

U.S. PATENT DOCUMENTS

| | | | |
|---|---|---|---|
| 3,142,415 | 7/1964 | Louchheim | 221/96 |
| 3,809,293 | 5/1974 | Chappell | 222/181.2 X |
| 4,561,571 | 12/1985 | Chen | 222/181.2 X |
| 4,621,749 | 11/1986 | Kanfer | 222/181.2 X |
| 5,421,489 | 6/1995 | Holzner, Sr. et al. | 222/181.2 X |

FOREIGN PATENT DOCUMENTS

| | | | |
|---|---|---|---|
| 4136047 | 5/1993 | Germany | 222/341 |

*Primary Examiner*—Joseph Kaufman

*Attorney, Agent, or Firm*—Antonelli, Terry, Stout & Kraus, LLP

[57] ABSTRACT

Usual liquid soap dispenser and the like are surface-mounted on the wall of a sanitary area and have an electrically or mechanically driven liquid pump, for example a swiveling lever. Besides the liquid pump, a sufficiently large liquid container must be arranged in the housing of the liquid soap dispenser, so that the liquid soap dispenser is bulky and more susceptible to soil and aging in the wet area. A liquid dispenser to be mounted in the wall is to be arranged as a unit behind a tile, so that the liquid container may swivel together with the tile. By actuating a bellows at the top side of the tile, pressure is applied on the liquid container, and liquid soap is ejected through an outlet. The liquid container associated to the tile is forcibly small. The distribution of small portions of liquid soap is thus not ensured. According to the invention, the dispenser (1; 133) is constituted of an elongated built-in housing (10; 110) that can be inserted into a cylindrical drilled hole (26), and of an elongated unit that may be slid for the most part into the built-in housing (10, 110). This elongated unit has a first slide in section (11; 130) with a reservoir (2, 3; 102) and a dosing pump (7; 107), and a second outer section with a mechanical pump drive (9; 129) with a push button (37, 74). The second outer section is integrated into an outer panel (5; 105) that cover the built-in housing (10; 110) in the wall.

1 Claim, 12 Drawing Sheets

DISPENSER FOR LIQUID DISINFECTANTS, SURFACTANTS, AND THE LIKE

BACKGROUND OF THE INVENTION

1. Technical Field

The present invention relates to a dispenser for liquid disinfectants, liquid surfactant products such as liquid soap, hand lotion, shower gel, shampoo, or for other liquids, with at least one supply container and at least one liquid outlet opening and with at least one pump unit being located between the supply container(s) and the respective liquid outlet opening and subjecting the liquid to pressure, and also with a housing part accepting at least the supply containers, with the dispenser being designed as a module that can be installed in a wall installation opening.

2. Prior Art

A dispenser for liquid soap and the like is known from DE 35 05 893 A1, the dispenser can be mounted in the rest room on the outside wall next to a washbasin or the like, and consists of a housing in which a supply container is provided for the liquid. A peristaltic pump is used as the metering pump for the liquid, the outlet of said pump making a transition through a hose to a handle that projects forward essentially horizontally, said handle serving as a crank lever for a mechanical drive of the peristaltic pump. Alternatively, the drive is provided with a foot-operated lever.

The simply designed mechanical drive of the peristaltic pump thus permits dispensing liquids in uniformly metered amounts.

DE 32 13 240 A1 is known as a dispenser for metered dispensing of liquid soap, with the user being obliged to place his hands near the outlet nozzle. A proximity switch then activates an electric drive for the metering pump and causes single or multiple ejection of a metered quantity of soap. The dispenser therefore requires an electrical power connection at the point where it is installed. This connection and the electronics used in the dispenser must also be given special protection against moisture to avoid a short circuit and a possible fire in the device. A dispenser of this kind must therefore be installed at a sufficient distance from water faucets.

These known devices for metered dispensing of liquid soap and the like are disadvantageous because they are mounted in a relatively large housing together with the supply container, which must be made sufficiently large for a prolonged period of use, and with the liquid pump and its drive, said housing being only surface-mountable on the tiled walls of the rest-room area. A projection is provided only rarely on tiled walls, so that the housing is accommodated out of sight in a niche. The bottom or top of the device must be freely accessible so that the crank lever mounted on the device, together with the outlet for the liquid soap or the foot-operated lever provided therein or the outlet nozzle provided therein together with a laterally mounted proximity switch, is freely accessible.

The dispenser housing is therefore mounted in a prominent location on the wall, and in the vicinity of the washbasin it takes up space that could be available for mounting other devices in the rest room. The dispenser housings made of stainless steel sheet or enameled sheet metal are thus exposed to increased contamination and aging in a wet area, and even when made of materials that are easy to care for are not often in a hygienically unobjectionable state. There is also the risk that the dispenser housing could be dented or damaged in some other way, or even torn violently off the wall on which it is mounted.

According to DE 93 06 291.5 U1 a liquid soap dispenser is already known which is designed, in combination with a square wall tile, so that it can be located behind the tile and is also removable from the wall. The tile is rotatably mounted in the dispenser frame which is installed in the wall. The upper part of the tile, which is forced into the frame during actuation, compresses a bellows that generates the pressure required to force the soap out of a container that is attached to the back of the tile and is pivotable together with the latter, while the lower part of the tile, which automatically projects outward, exposes the opening of the dispenser.

In accordance with the usual dimensions of rectangular tiles, the dispenser frame has an opening cross section 10 to 15 cm in length and height. The container installed as a pivotable unit together with the tile has only a limited depth and has the lower part bevelled to permit the lower part of the tile to emerge from the dispenser frame. The volume of the container is small and a drip-free seal for the outlet opening located on the underside of the container is provided by a rubber gasket. Especially when retrofitting the dispenser, the installation opening, which must necessarily be rectangular in cross section, must be made precisely, and there is a danger of lateral tiles being damaged and hence having to be relaid.

SUMMARY OF THE INVENTION

Hence the goal of the present invention is to improve these known dispensing devices in such fashion that a compact dispenser is obtained which, while permitting a readily accessible and hygienically unobjectionable method of dispensing, is accommodated for the most part in an installation recess that is made only relatively small, and thus remains readily accessible for servicing.

The part of the dispenser that is installed in the wall installation opening must be so designed that it can be accommodated for the most part in a recess produced by one or more cylindrical core-drilled holes that merge with one another, and, especially for retrofitting, can be readily installed in the wet area in walls that have already been tiled, without damaging the tiles at the sides, at a depth that exceeds most of the given wall thickness.

The dispenser according to the invention requires, at the intended mounting location in a given wall, the previous or subsequent provision of an installation recess that is dimensioned in accordance with the dimensions of the wall installation housing to be used, said housing being provided with a suitably dimensioned cylindrical receptacle for mounting an installation section of the structural unit that is elongate and compact and includes one or more supply containers and/or the required metering pump and its drive. This module is designed as a rest-room installation element and can therefore be provided externally either with one or more dispensing heads, with pump unit(s) and/or liquid outlet openings provided for the various supply containers, or involving the formation of an access gap in the lower area of the wall installation housing that is freely open to the exterior, or with one or more liquid outlet openings located there. Since the liquid outlet openings are protected from the outside, and are mounted on the underside of the dispensing heads, a hygienically unobjectionable and readily accessible outlet for the liquid is provided. The external shield covers from the outside the rest-room installation element mounted in the wall installation housing. Even when the external shield is installed with one or more external axially projecting dispensing heads to receive and/or install the outlet nozzles and/or liquid outlet openings, the latter can be provided for the most part in a flat or slightly convex external shield of the wall installation housing. The external shield, which projects only slightly toward the outside, is then subject to only minor contamination and, if necessary, can be cleaned at the same time as the adjacent mirror, tile, and other wall surfaces of the wet area.

Since a large part of the dispenser is inserted and secured in an installation opening, together with the wall installation housing surrounding it, as a rest-room wall installation element with a compact elongate shape, the installation opening to be provided can have a relatively small opening cross section. While the wall installation housing is secured permanently in this elongate installation opening, the installation of the rest-room wall installation element in the wall installation housing is accomplished with readily releasable connecting means, permitting removal of the entire dispenser including the wall installation housing, e.g. after simply unlocking the connecting means, by pulling it out of the installation opening.

It is therefore possible, in the case of a defective dispenser, to replace the wall installation element as a whole after pulling it out of the installation opening together with a supply container, metering pump, and electrical or mechanical drive, and to replace it with a new rest-room wall installation element or to refill with liquid a supply container that is freely accessible after removing the wall installation element, or to replace said container by other, already filled, supply containers. As connecting means between the rest-room wall installation element and the wall installation housing, a claw lock or a bayonet lock can be provided. In addition, a sealing plate can be located behind the external shield of the dispenser to cover the entire installation opening from the outside. To actuate the connecting means, a locking element can be provided on the back of the sealing plate, said element being pivotable by an external actuating mechanism in such fashion that it can be engaged with and disconnected from two opposite external locking openings in the wall of the wall installation housing by means of external locking claws.

In another embodiment, by means of a lengthwise sliding guide, optimal mounting of the wall installation element with respect to the wall installation housing is achieved, so that the wall installation element can be readily removed or installed. The guide rails and/or ribs incorporated into the wall installation housing can simultaneously have lengthwise struts or sections of the wall installation housing that connect in the axial direction to external, bent, circular metal bands forming a cylindrical hollow body that is open to the jacket surface between these sections. The wall installation housing can have an elongate cylindrical shape or is composed of a plurality of horizontal hollow cylinders that are partially nested into one another, with such a wall installation housing being insertable into a corresponding arrangement of horizontal core-drilled holes that are merged with one another. The supply container(s) can be mounted inside this receptacle of the wall installation housing, said containers combining to form a cylindrical tank or form a combination of two or more hollow cylinders that fit together laterally.

With such a design of the wall installation housing, of the rest-room wall installation element, and of the supply container located over a large part of the length of this wall installation element, a compact design of the dispenser is achieved, and an installation opening is provided that is relatively small by comparison with its size. The installation opening, the wall installation housing, and the rest-room wall installation element are made circular or in the form of segments of a circle in cross section. In contrast to a design of the wall installation element that is rectangular in cross section for example, because of the cylindrical design, practically the entire receiving area of the wall installation housing can be used to provide a wall installation element that is made slightly smaller in cross section. The core-drilled holes can then be made easily using suitable drills in cinder-block or brick walls, as well as concrete walls. By using such devices, tiled areas can be drilled without the adjoining tile area being damaged.

Provision can be made such that the pump housing of the wall installation element, which receives the pump unit, is located outside the wall installation housing, in other words on the outside of a sealing plate for example that closes off the installation opening at this point. The length of the pump unit can be made relatively small when the liquid is to be dispensed in individual small portions, and an extrusion pump in the form of a piston slide pump with a metering cylinder about 2 cm long and about 1 cm in diameter will suffice. As a result of the design thus provided or the external arrangement of the pump unit, it is possible to locate a large part of the rest-room installation element in the installation opening, with the outwardly projecting part with its metering pump and pushbutton or metering button being designed with a relatively short shape.

On the inside of the sealing plate of the wall installation element, a carrier plate bent at 90 degrees can be provided which either holds one or more supply containers or itself constitutes a wall area of a supply container. This produces a compact, stable design for the installation element as well as a compact arrangement of the supply container. The supply containers, can also be preferably mounted on the-carrier plate so that they can be released individually, said containers, fitting together and having the shape of individual cylindrical segments that combine to form an elongate cylindrical tank. The supply containers can be mounted one above the other by meshing the outlet stubs and inlet openings. On the outside of the supply container or the carrier plate that runs perpendicularly to the sealing plate, externally on the lengthwise edges, grooves or tongues to form the lengthwise sliding guides for the wall installation element can be provided. The supply containers can be arranged with respect to one another, with one above the other in such fashion that the liquid flows largely automatically down through a lower liquid outlet located on the bottom of the container of the lowest supply container and through an adapter unit to the metering pump. In theory, a wide variety of metering pumps can be used, with a metering pump with a mechanical actuating device and a piston slide pump (compressor pump) being provided. To drive the metering pump, it is necessary to displace the metering piston to perform the suction and pressure strokes. This lengthwise displacement of the metering piston can be accomplished by actuating a pushbutton that projects outward from of a dispensing head, and, on a parallel guide, guides the pressure cylinder in a lengthwise displaceable manner in the lengthwise direction of the metering cylinder.

The pump inlet and pump outlet of the piston slide pump can each have an adapter unit with a check valve or an overpressure valve. In this manner a situation is created in which the liquid is dispensed outward through the liquid outlet opening of the dispenser during the pressure stroke, while during the suction stroke, after closure of the opening that leads to the exterior, only liquid from the supply container and the adapter unit leading thereto can flow into the metering cylinder.

The design of the pump unit as well as the design of the connecting and locking means permit an extremely compact arrangement of the pump unit and connecting and locking means on the front of the sealing plate, which can be covered by an inconspicuous external shield. The supply containers of the rest-room installation element can therefore essentially fill the entire cylindrical receptacle of the wall installation housing, despite the fact that, in order to install a pump unit or liquid outlet openings, the latter must be provided in the part of the installation element itself that is slid inward or in an access gap located below it.

The metering pumps according to the invention are understood to be compressor pumps with a metering cylinder or pump barrel that receives a certain volume of liquid, which is then compressed to a certain volume and dispensed

BRIEF DESCRIPTION OF THE DRAWINGS

The design and installation of the dispenser designed as a wall installation unit will now be described in greater detail with regard to two embodiments with reference to the drawing. The drawing shows.

DETAILED DESCRIPTION OF THE PREFERRED EMBODIMENTS

Figure 1:
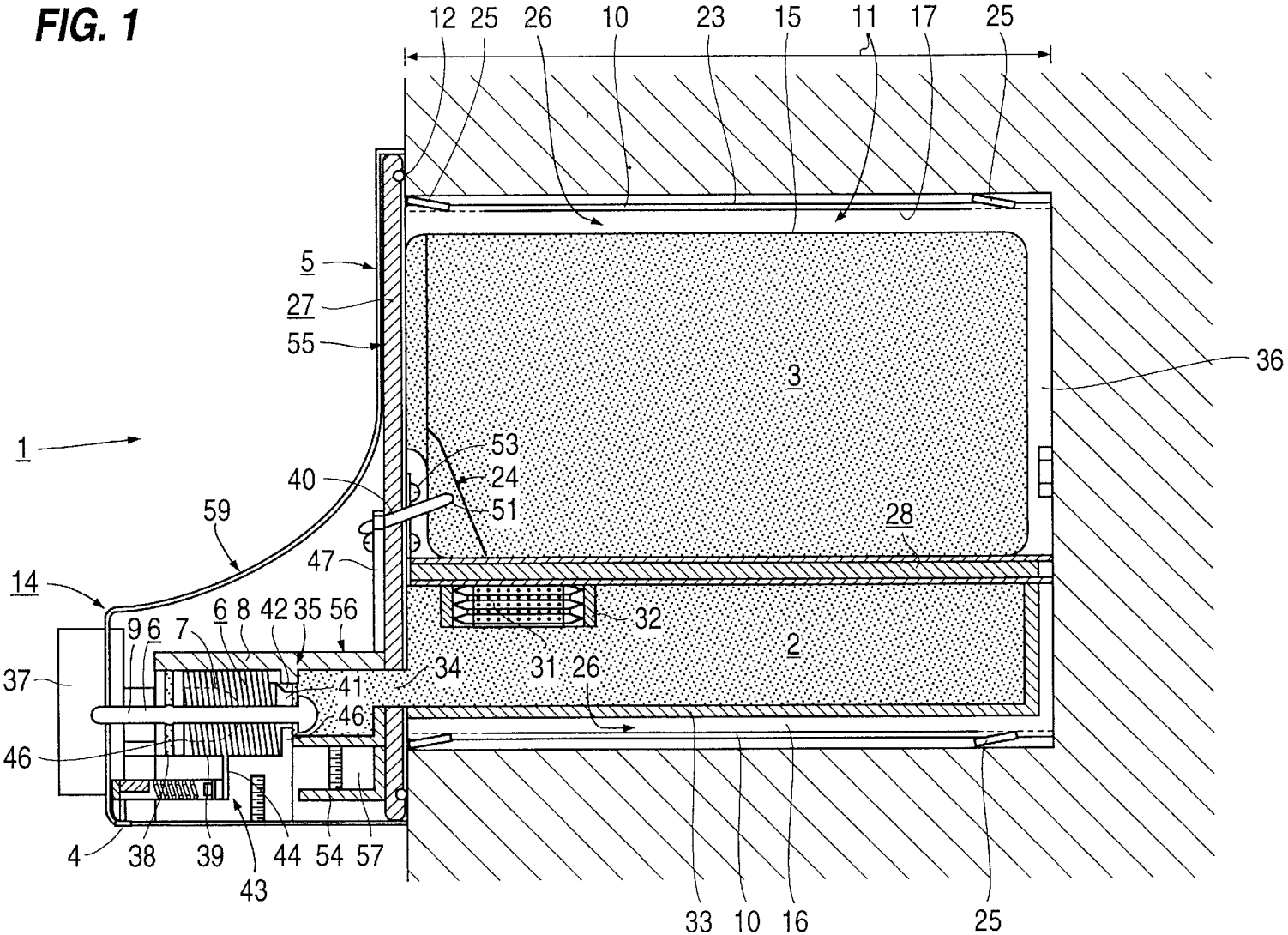
FIG. 1 is a lengthwise section through the dispenser installed in an elongate cylindrical installation opening, with two supply containers being located laterally at the right of a sealing plate and of an external shield covering the latter, with a slightly larger upper supply container being plugged into a lower, smaller container that forms a horizontal supporting plate, and with the external shield, beginning at approximately the middle area, tapering downward laterally to the left of the sealing plate into an axially projecting nose that forms a dispensing head in which a metering pump (piston slide pump) that can be actuated by an anterior pushbutton is located and covered, and from which liquid escapes downward through a liquid outlet opening. The actual outlet nozzle of the metering pump is covered by the dispensing head formed in the external shield as an axially projecting stub, so that the outlet of the metering pump cannot be contaminated. In the metering head, moreover, an adjusting slide displaceably mounted on the outer surface of the sealing plate is received, by which slide the connecting means of the rest-room installation element can be actuated with respect to the wall installation housing.

The dispenser (1) shown in FIGS. 1–14 for liquid soap and the like consists of two supply containers (2, 3) for this liquid that are located one above the other, a wall installation housing (10) installed in a cylindrical installation opening (36) in which dispenser (1) is to be installed, an external sealing plate (27) that extends over end (13) of receptacle (26), and of a connecting means (24) in the form of a claw lock for holding sealing plate (27) with supply containers (2, 3) fastened thereto against wall installation housing (10), with the lock of the connecting means (24) being engaged and disengaged by means of an external actuating mechanism located on front (55) of sealing plate (27), as well as of a pump housing (8) mounted outside sealing plate (27) with a metering pump (7) in the form of a piston slide pump. This pump unit (6) can be actuated by a mechanical drive (9) made in the form of a pushbutton (37) with a parallel guide for displacing metering piston (38) of the piston slide pump.

Pump unit (6) and pump housing (8) are mounted in an external axially projecting dispensing head (14) that merges with an external shield (5) that closes off the entire sealing plate (27) from the exterior.

The two supply containers (2, 3) can be locked to a support plate (28), said containers being connected together by means of an outlet stub (31) of upper supply container (3)

that engages an inlet opening (32) of lower supply container (2). Support plate (28) is then fastened together with supply container (2) to the back of sealing plate (27). Pump housing (8) is fastened at front (55) of this sealing plate by an intermediate piece (56) to sealing plate (27) and hence to support plate (28) and the two supply containers, so that these parts form a module.

Cylindrical opening (6) in the masonry is made as an elongate core-drilled hole, with wall installation housing (10) having a suitable shape. It can then be centered by means of tabs (25) inside cylindrical opening (36).

Figure 10:
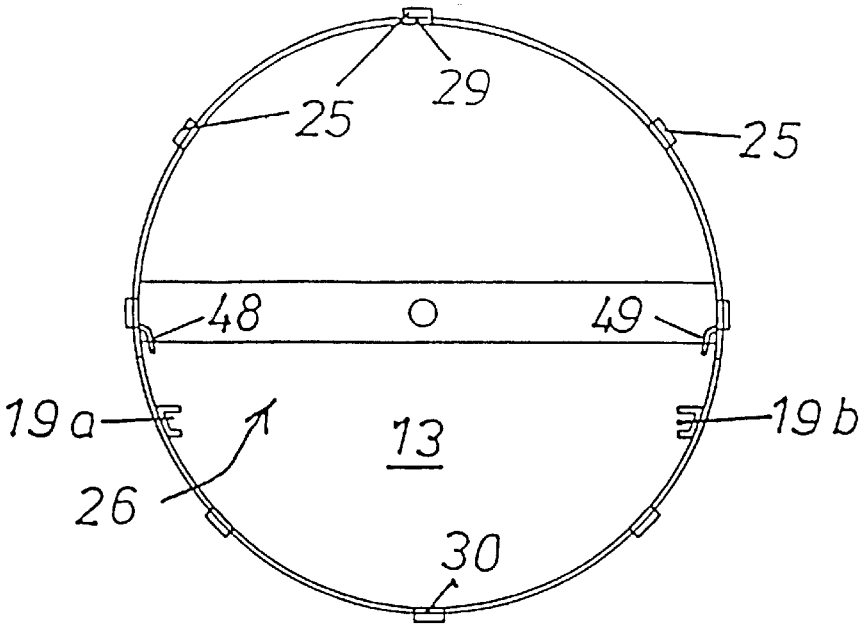
FIG. 10 and FIG. 11 show an end view and a side view of the wall installation housing formed of shaped ribs.
Figure 11:
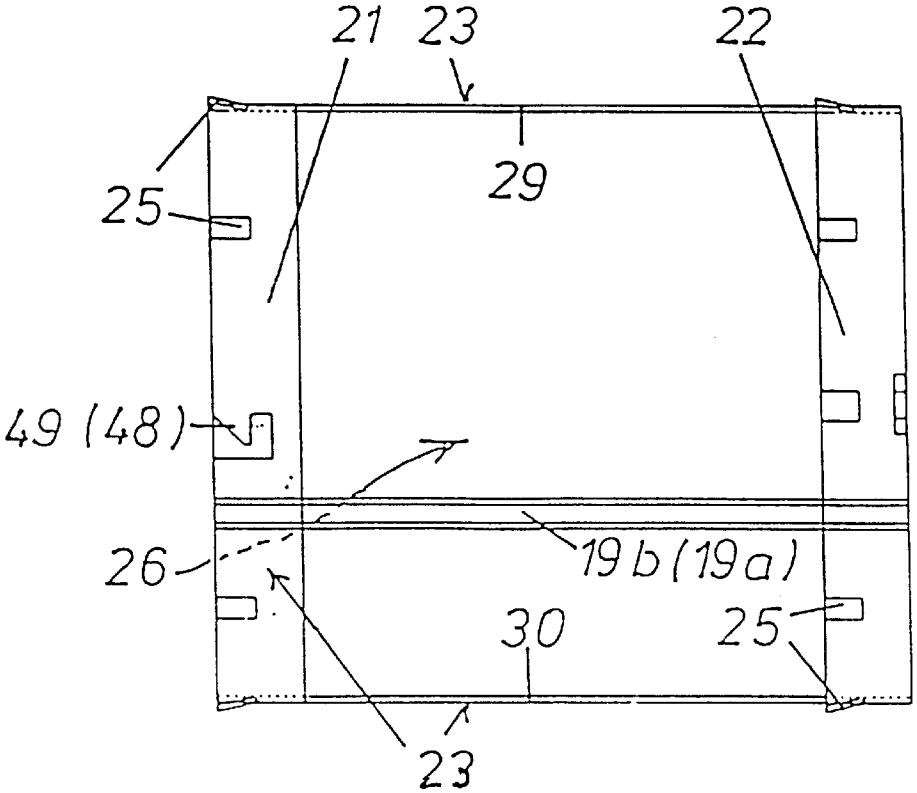

Wall installation housing (10), as shown in a front view and side view in FIGS. 10 and 11, forms a cylindrical elongate receptacle (26), in which, by means of a lengthwise slide guide (18) mounted on inside wall (17), the part of dispenser (1) located to the right of sealing plate (27) can be inserted together with supply containers (2, 3) and the connecting means.

Dispenser (1) can then be pulled as a compact elongate module together with anterior pump housing (8) and external pushbutton (37) out of receptacle (26) of the wall installation housing, while previously external shield (5) together with the dispensing head molded in it and sealing plate (27) supporting these parts must be released. Connecting means (24) must be unlocked.

Since pump housing (8) is located outside the sealing plate, the advantage is obtained that the length of the installation opening to be provided in the masonry, and hence the length of wall installation housing (10), can be shortened. Depending on the thickness of the masonry, the section of the rest-room installation element to be mounted in wall installation housing (10) can be made with different lengths. Provision can also be made for integrating the pump housing into supply containers (2, 3) so that it is received completely in wall installation housing (10) or in the installation opening provided in the masonry, up to outer pushbutton (37) and external shield (5) surrounding the latter.

Figure 12:
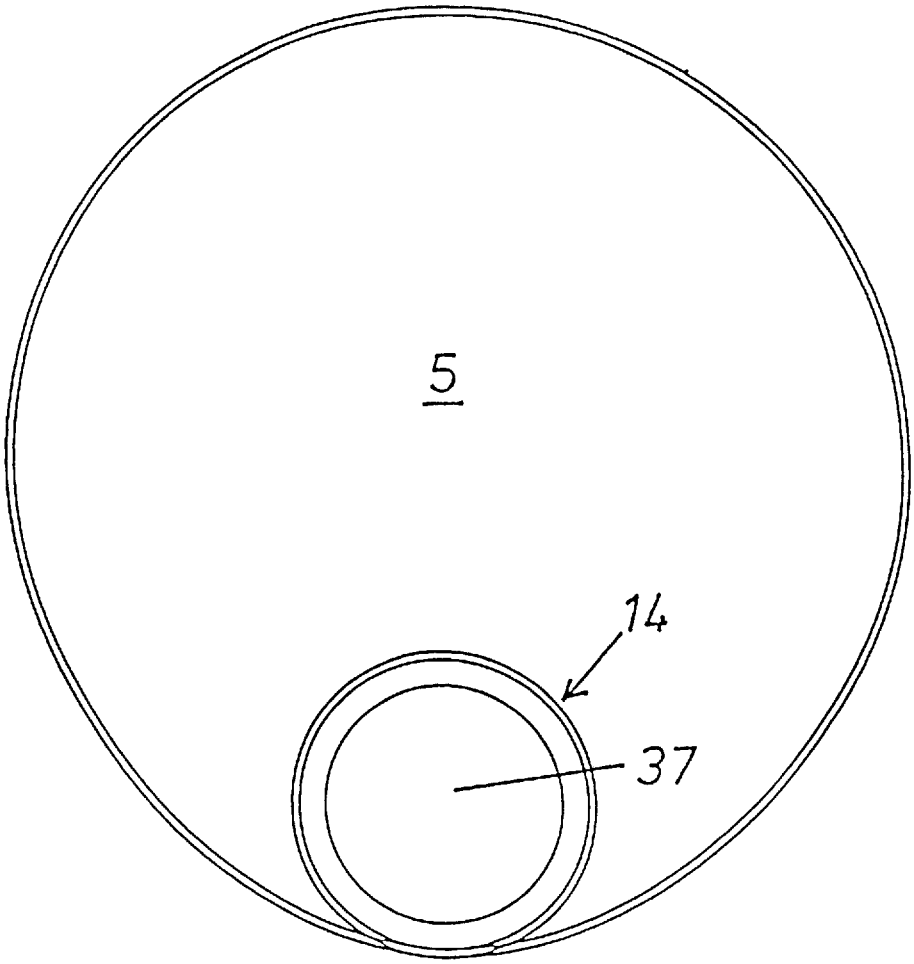
FIG. 12 is a front view of the external shield with a centrally disposed dispensing head in the lower area, with a receptacle for the pushbutton of the piston slide pump to be used.
Figure 13:
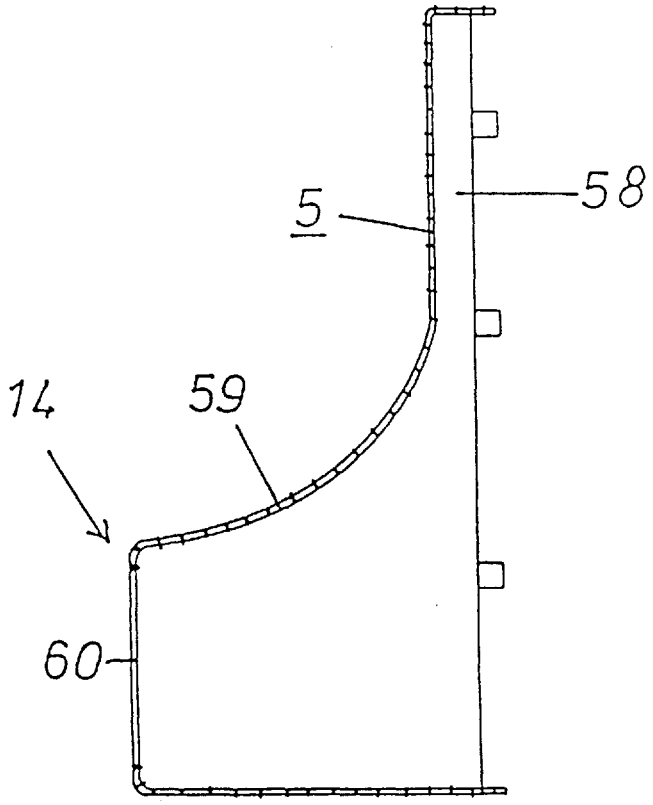
FIG. 13 is a side view of this external shield according to FIG. 12.
Figure 14:
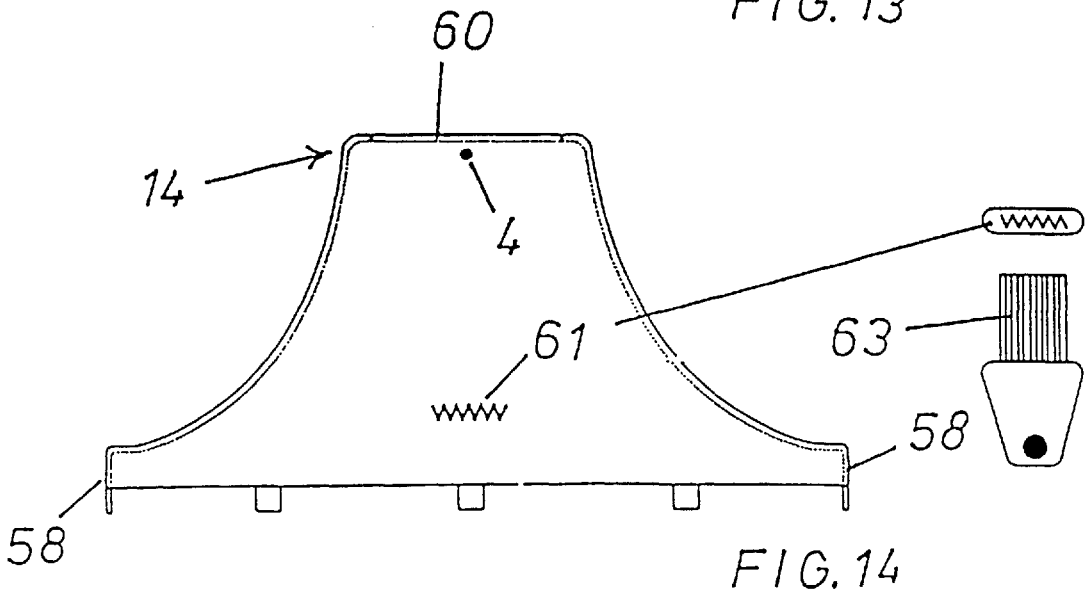
FIG. 14 is a bottom view of this external shield according to FIG. 12, showing the liquid outlet opening located in the axial outer area as well as an opening slot for insertion of a metal Allen wrench that displaces the adjusting slide of the connecting means to unlock it.

Since in the present embodiment pump, housing (8) is mounted on the underside of sealing plate (27), dispensing head (14) molded in external shield (5) according to FIGS. 12, 13, and 14 can terminate as an axially outward projecting extension with slight convexity at the surface of the external shield, while on the underside of the dispensing head the latter makes a straight-line transition into the side edge of external shield (5) which is folded at 90 degrees.

On this underside, liquid outlet opening (4) is provided, with the outlet nozzle of piston slide pump (7) being guided directly to a point immediately in front of this liquid outlet opening (4).

Since all the parts except pushbutton (37) of dispenser (1) are covered by external shield (5), sealing plate (27), and dispensing head (14) molded on the external shield, hygienically unobjectionable dispensing of the liquid soap is obtained, with the dispenser being easy to clean externally. The dispenser designed as a rest-room installation element (11) is thus readily accessible, with it being sufficient, in order to top up the liquid, to actuate an external adjusting mechanism (47, 53) so that connecting means (24) are released from the wall installation housing. By means of a sealing ring mounted on the back of sealing plate (27), said ring coming to rest outside the installation opening against the surrounding masonry wall located externally there, a tight, stress-free installation of rest-room element (11) in wall installation housing (10) is possible.

To service pump unit (6), it is merely necessary to loosen external shield (5) with molded dispensing head (12) and sealing plate (27) and to pull rest-room installation element (11) out of wall installation housing (10). Supply containers (2, 3) as well as sealing plate (27) and carrier plate (28) are made of plastic. While to be on the safe side lower supply container (2) should be kept constantly full, upper supply container (3) is provided as a topping-up tank, with the latter having the largest capacity. Supply containers (2, 3) are then located above liquid outlet (34) located on the bottom (33) of the container, said outlet communicating with metering pump (7) designed as a piston slide pump. A pump housing (8) is mounted on sealing plate (27), said housing forming an intermediate piece (56) for mounting external adjusting mechanism (47, 53) as well as metering cylinder (39). The metering piston, which is displaceable lengthwise in this metering cylinder, is then displaced by adjusting pushbutton (37) against a compression spring (46). Since an adapter unit (35) with a check valve (42) is located in a connecting bore (41) that feeds the metering cylinder, and an adapter unit (43) with an overpressure valve (45) is located at the outlet in a connecting duct (44) to liquid outlet opening (4), during the suction stroke of piston (38) liquid soap flows from supply container (2) into metering cylinder (39), with pressure valve (43) closed, and during the pressure stroke, with check valve (42) closed, the liquid soap drawn into the metering cylinder is dispensed through overpressure valve (43) and an outlet nozzle into liquid outlet opening (4). It is then possible to expel all of the liquid contained in the metering cylinder as a single premeasured batch or merely a portion thereof.

In the present embodiment, the pump housing, measured from liquid outlet opening (4) to sealing plate (27), has a length of 5 cm. The length of the metering cylinder itself is 2.5 cm, and the cylinder has an opening cross section of 1.5 cm. The total length of the rest-room wall installation element is 18 cm, with the part that is inserted into the wall installation housing measuring 12 cm. Wall installation housing (10) has a diameter of 10 cm. The width of the support plate (28) formed by lower supply container (2) is 8.8 cm. The rest-room wall installation element (11) shown in FIG. 2 corresponds to the drawing in FIG. 1, with outer wall installation housing (10) and upper supply container (3) omitted for the sake of clarity.

Figure 3:
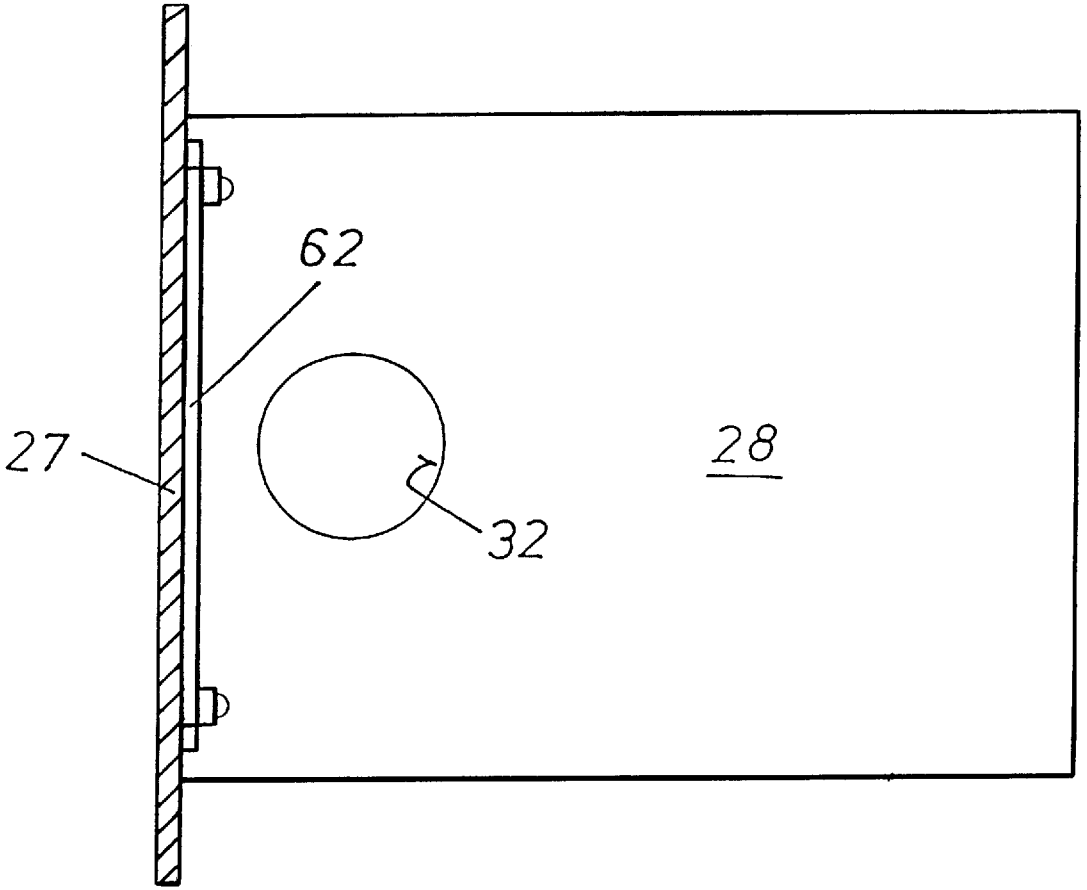
FIG. 3 is a top view of the top, formed as a carrier plate, of this lower supply container on the sealing plate and a locking element located in its interior.
Figure 4:
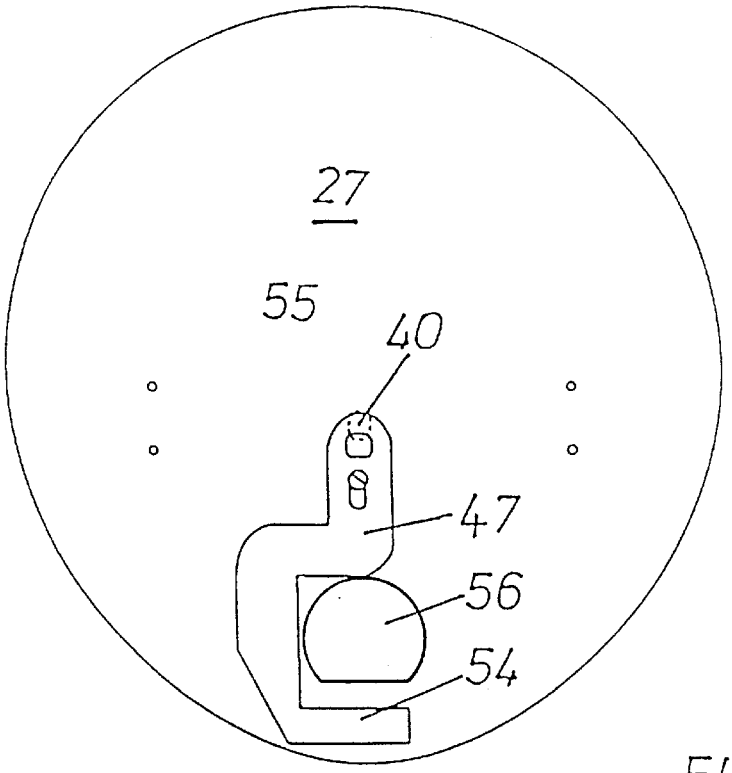
FIG. 4 is a front view of the outside of the sealing plate showing the positioning slide located lengthwise displaceably on the plate for unlocking or locking the connecting means, said slide being guided in the lower area by a bent, forked end piece around an intermediate piece that leads to the pump housing and is designed at the lower end as a pushbutton.
Figure 5:
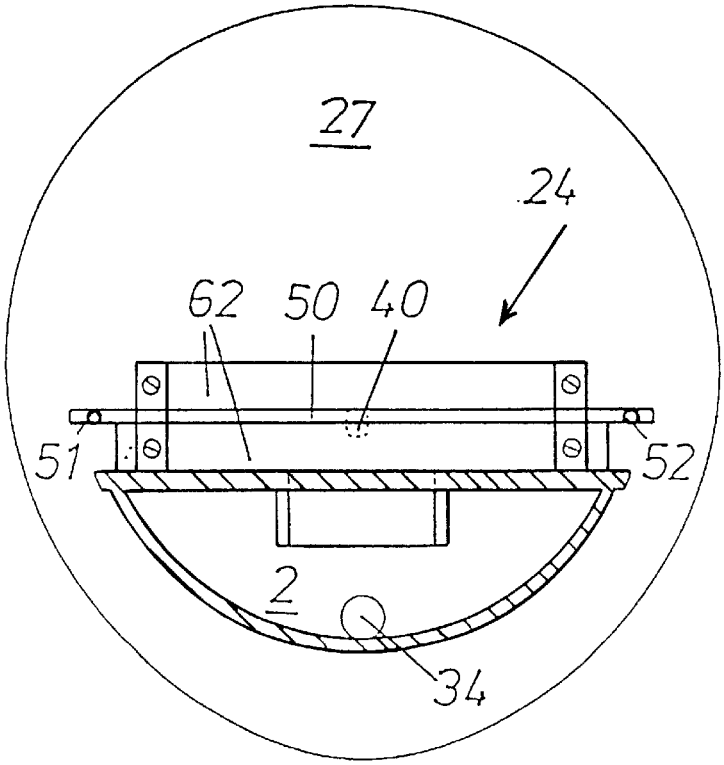
FIG. 5 is a rear view of the sealing plate according to FIG. 4 showing a locking element formed by a horizontally located bent wire, said wire emerging laterally outside locking cams that engage the wall of the wall installation housing, and guided by means of a projection in the middle through an elongate hole of the sealing plate to the adjusting slide that is guided on the front and thus engages the latter.

The components in this drawing are given the reference numerals used in FIG. 1. In FIG. 3, in a top view, support plate (28) and sealing plate (27) are shown with retaining ribs (62) located therein for supporting locking element (50) according to FIG. 5. On the front of sealing plate (27) FIG. 4 shows adjusting mechanism (47, 53) for connecting means (24) provided on the back of the sealing plate for securing the rest-room wall installation element in wall installation housing (10).

An adjusting slide (47) is located on flat front surface (55) of sealing plate (27) corresponding to the elongate hole formed in it in a lengthwise displaceable manner. Since intermediate section (56) that leads to metering cylinder (39) is located below the lengthwise guide of adjusting slide (47), the latter is guided by a forked extension laterally downward around intermediate section (56). Intermediate section (56) thus acts as a stop for adjusting slide (47). It contains a prechamber (46) for a guide rod for adjusting check valve (42). By means of wire-shaped locking element (50) located on the back of adjusting plate (27), connecting means (48, 49, 50, 51, 52) forming a claw lock are connected with adjusting slide (47). Locking element (50) has an extension (53) in the middle that extends through an elongate hole (40) in sealing plate (27) and engages a corresponding guide in sealing plate (27).

Locking element (50) is then made with a length that corresponds to the aperture width of receptacle (26) of wall installation element (10). By means of external locking claws (51, 52), locking element (50) mounted on sealing plate (27) thus engages locking openings (48, 49) on inside wall (17) of wall installation housing (10). These locking openings (48, 49) are shown in the front and side views of the wall installation housing in FIGS. 10 and 11. According to these figures, the wall installation housing is made of a basket-like metal cylinder with an open end (13) at the front and whose cylindrical wall consists of two external circular surrounding metal bands (21, 22) and lengthwise struts (19*a, b*) made in the form of guide rails and connecting the bands lengthwise, and additional connecting ribs and sections (29, 30). At the end of the wall installation housing the latter has a cross rib in which a mounting bore is located. On outside wall (23), the above-mentioned spacing tabs (25) are arranged uniformly above circular metal bands (20, 21).

Figure 6:
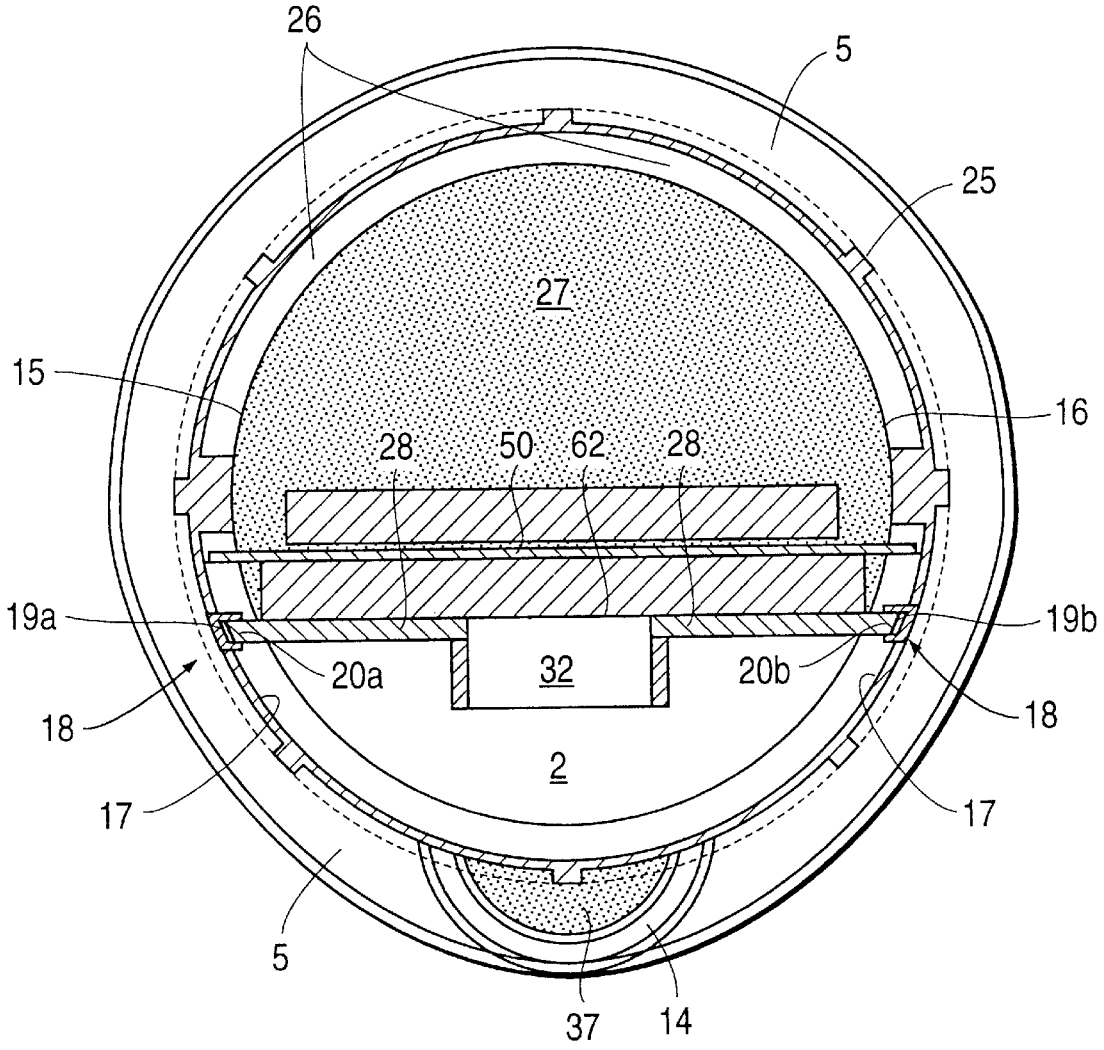
FIG. 6 is a rear view of the sealing plate according to FIG. 5 corresponding to a section through the inlet opening of the lower supply container, showing the arrangement of the rest-room installation element inside the outer wall installation housing, the wall of the installation opening indicated by the stripes, and the external shield that projects laterally, radially and outward from the sealing plate, with a dispensing head molded in the lower area as a projecting stub.
Figure 7:
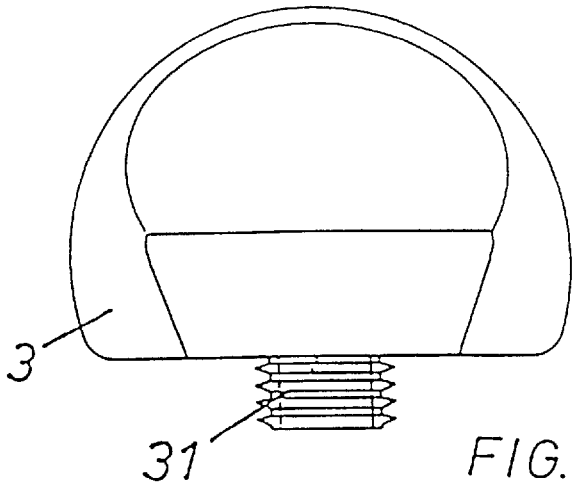
FIG. 7 and FIG. 8 show a side view and an end view of the upper supply container used as a topping-up tank.
Figure 8:
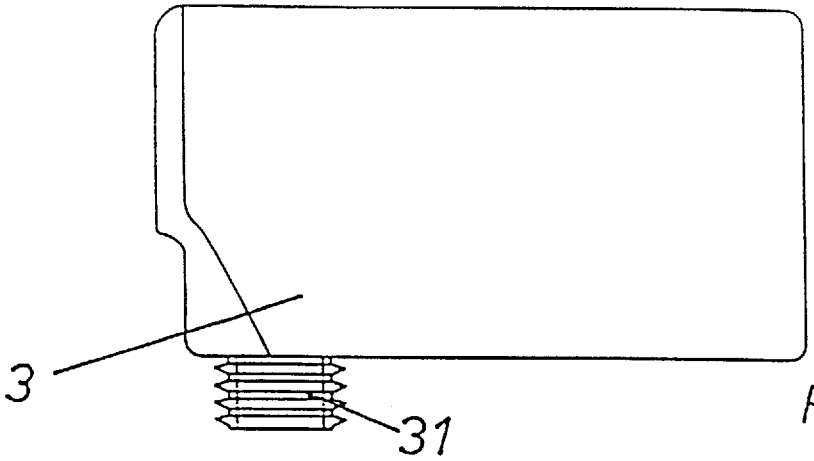
Figure 9:
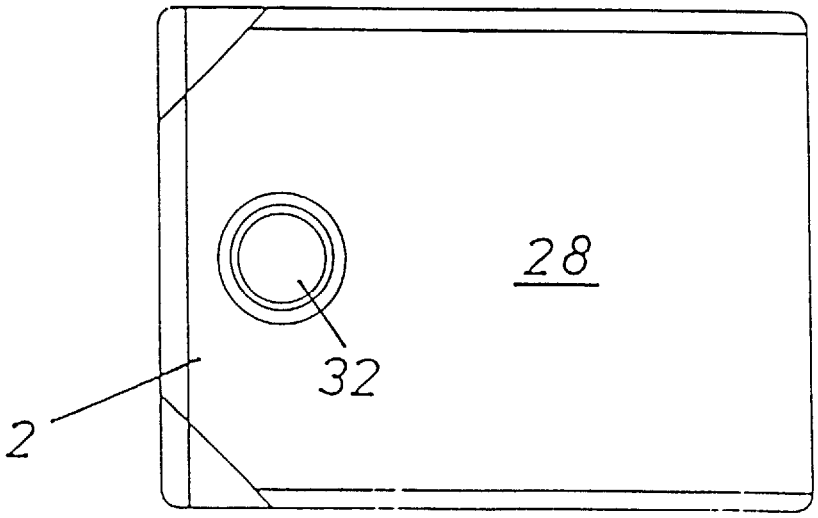
FIG. 9 is a top view of the lower supply container serving simultaneously as a support for the upper supply container and being interchangeable by comparison with FIGS. 2 and 3, with FIGS. 8 and 9 showing the position of the outlet stub of the upper container that is inserted into the inlet opening of the lower container.

The installation of elongate rest-room installation element (11) inside wall installation housing (10) by means of a lengthwise sliding guide (18) is shown in FIG. 6. Guide rails (19*a, b*) can be seen extending along inside wall (17) in the lengthwise direction, said rails, with a lengthwise receptacle, guiding external guide ribs (20*a, b*) of rest-room wall installation element (11), said ribs abutting external lengthwise sides (15, 16). In addition, lower supply container (2) with its inlet opening (32) is shown, as well as the mounting of the elongate wire-shaped locking element (50) of claw lock (24) on the back of sealing plate (27). Pivotable or rotatable mounting of locking element (50) is provided by an elongate rib mounted above and below it, opposite sealing plate (27).

Outside the wall of wall installation housing (10) the limits of the installation opening provided by a core-drilled hole are indicated by the dashed lines. Outside this area the vent edge of external shield (5) and the dispensing head (14) molded therein are shown along with pushbutton (37) guided in the latter.

The external shield (5) shown in different views in FIGS. 12 to 14 has in its lower area a projecting stub (59) in the form of a dispensing head (14). In a circular opening (60) of the dispensing head, pushbutton (37) is provided displaceably to actuate the piston slide pump.

External shield (5) has a bent circumferential edge piece (58) for mounting on the external surrounding end face of sealing plate (27) (press fit).

In FIG. 14, in a bottom view of metering head (14), the liquid outlet (4) located in the vicinity of opening (60) and an opening slot (61) located near edge piece (58) are also shown, which allow adjusting slide (47) to be moved by means of a wrench (63) inserted thereinto against spring force to unlock locking claws (51, 52).

Figure 2:
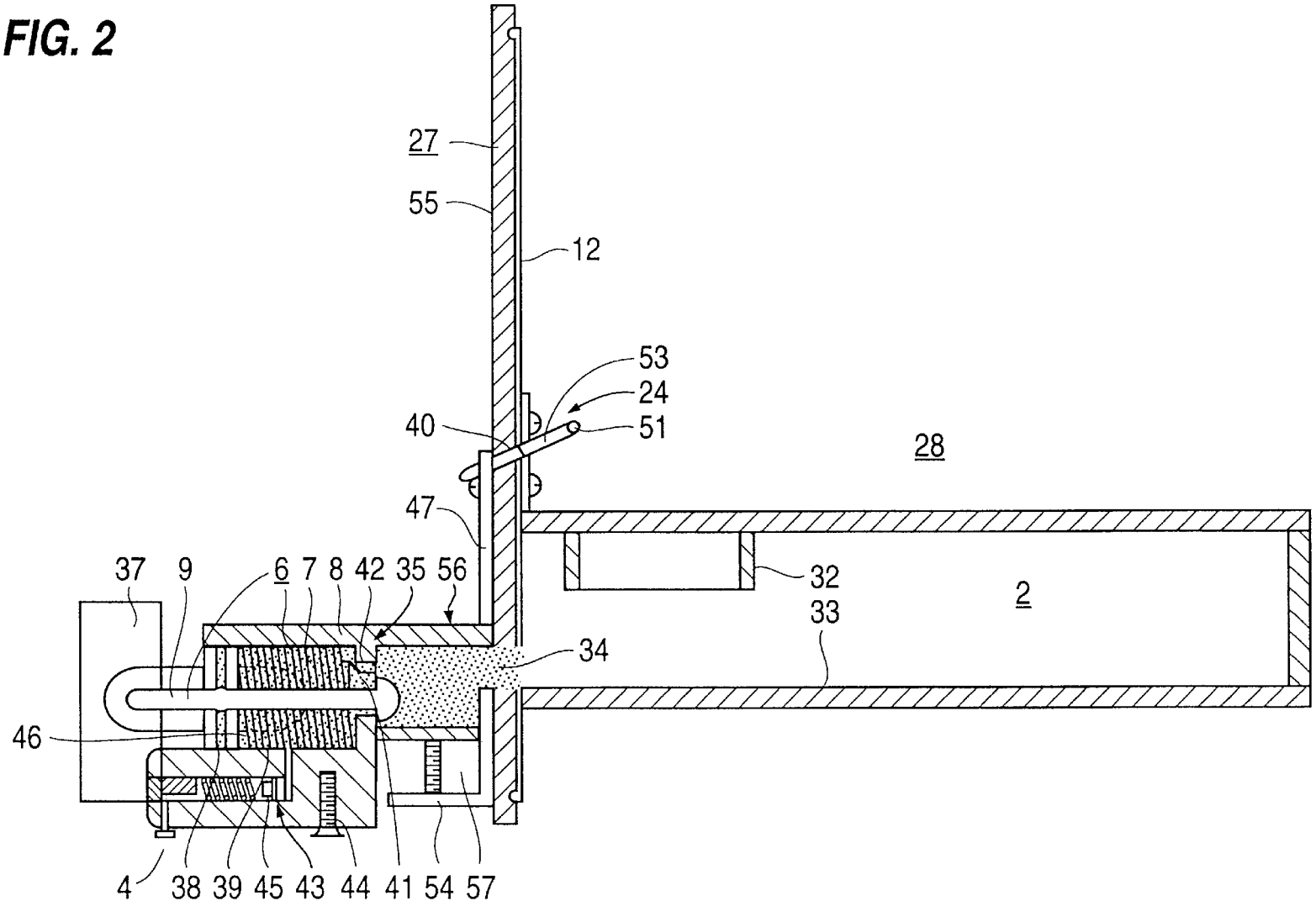
FIG. 2 is a simple diagram of the pump unit located laterally to the left of the sealing plate with the actuating mechanism mounted on the front and rear of said plate, for the connecting means of the installation element with respect to the wall installation housing with a simultaneous representation of the lower supply container permanently mounted to the right of the sealing plate, in lengthwise section.
Figure 15:
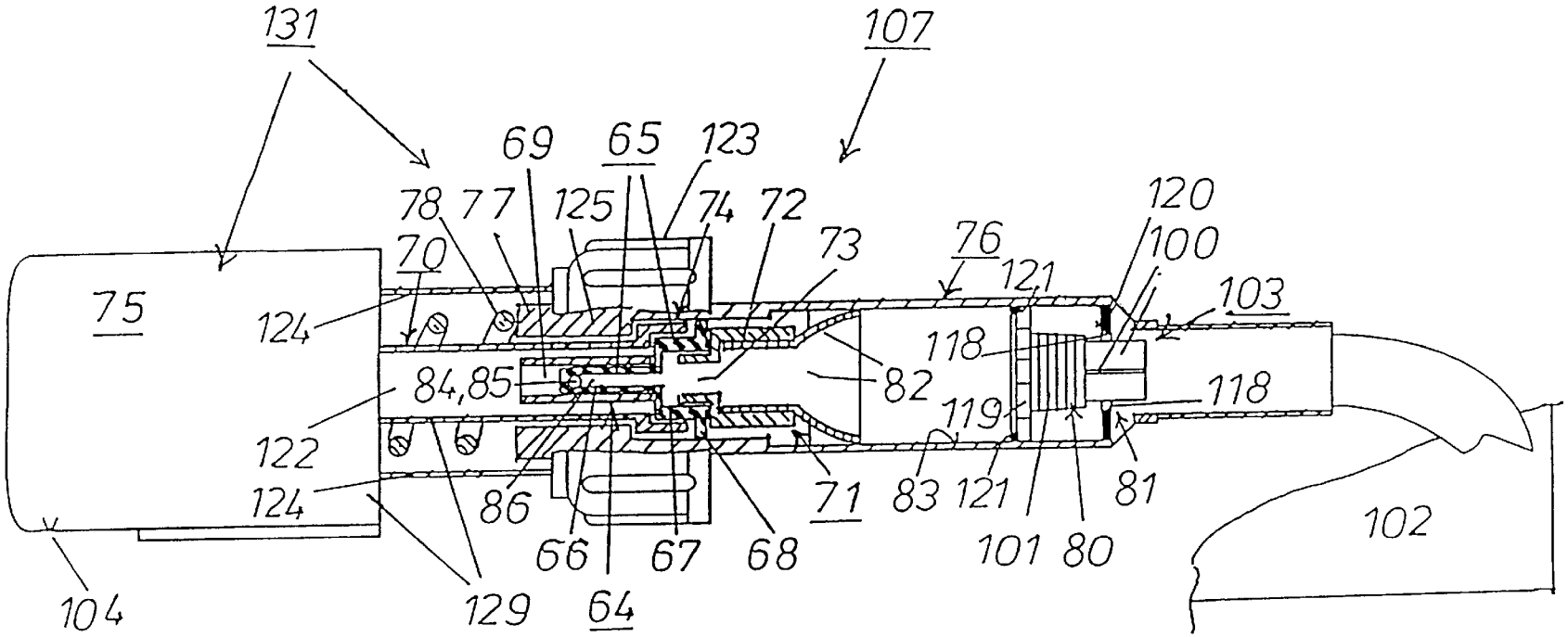
FIG. 15 is a side view of a piston slide pump to be used in a preferred embodiment of the dispenser according to FIG. 17, with a tube valve, partially in lengthwise section.
Figure 16:
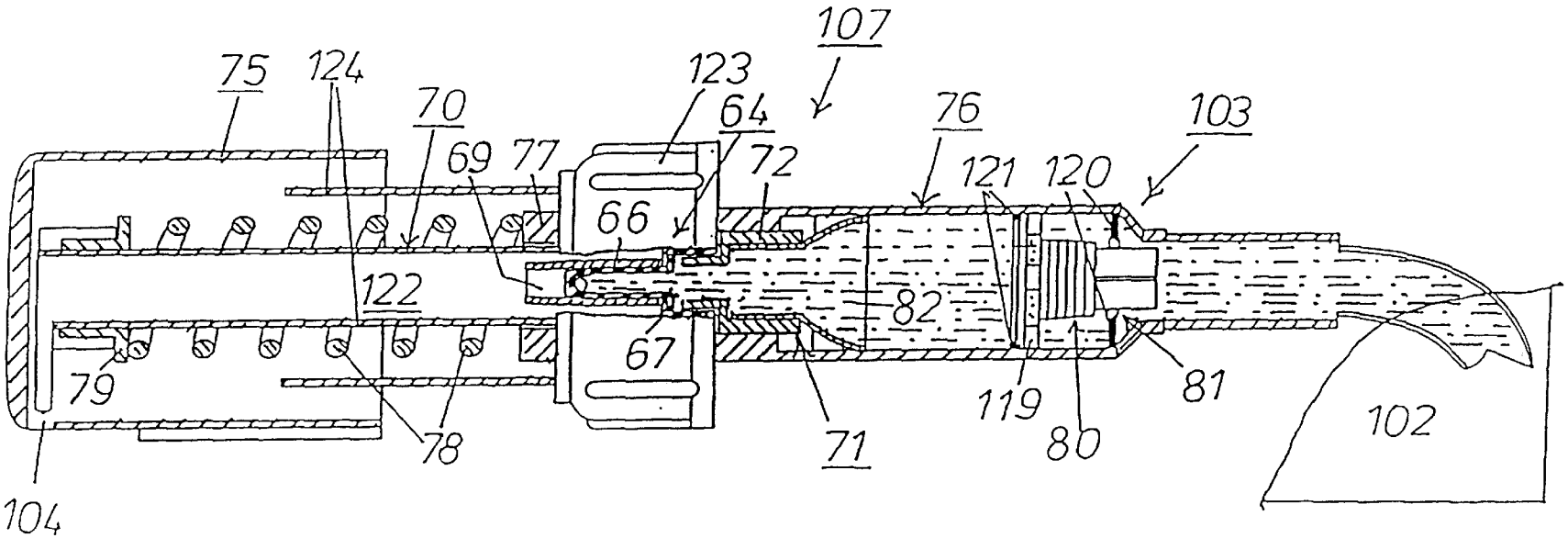
FIG. 16 is a view of the piston slide pump according to FIG. 15 with additional indication of the location of the tension spring to return the pump sleeve and the liquid that is then sucked into the pump barrel during the suction stroke.
Figure 17:
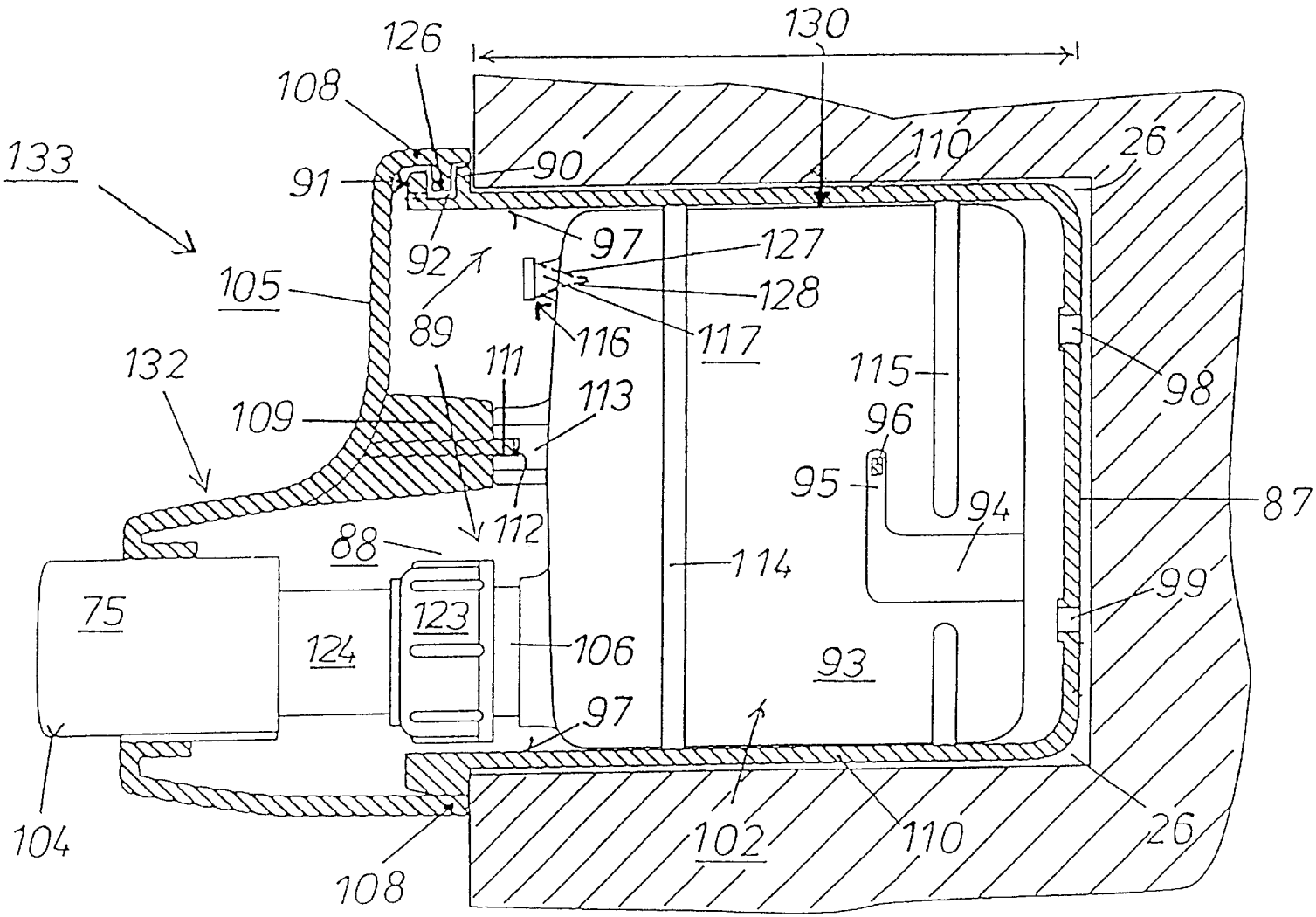
FIG. 17 is a preferred embodiment of the dispenser, shown partially in lengthwise section and a side view.

In a preferred manner, piston slide pump (107) shown in FIGS. 15, 16, and 17, which has a tube valve (64), is used instead of piston slide pump (7) shown in FIGS. 1 and 2 for metering the liquid disinfectant and surfactant products in the dispenser. Piston slide pump (107), like piston slide pump (7) in FIGS. 1 and 2, can be disposed in a horizontal plane with respect to the floor, in other words at right angles to the wall, the inflow opening being in the lower part of supply container (2) or supply container (102) with respect to the other embodiment of the dispenser according to FIG. 17, without the liquid in the supply container making piston slide pump (107) leak, despite the hydrostatic force that operates.

Therefore, especially when it is necessary for piston slide pump (107) to be absolutely tight, this pump must not be mounted perpendicularly to the floor inside supply container (102) or laterally outside it. Conventional liquid pumps, on the other hand, in order to achieve a high degree of tightness, must be mounted with an "up-side arrangement" of the pump body, in other words with the liquid valve located in the upper part, in or on the supply container.

According to FIG. 15, tube valve (64) of piston slide pump (107) consists of a valve body (65) whose left-hand cylindrical part (66) has two radial valve openings (84, 85) and an axial blind hole (86) that opens on the right. Valve opening (85) is covered in the drawing by the side with valve opening (84). An elastic tube section (69) is drawn over longer cylindrical part (66), on the outside thereof and above valve openings (84, 85) terminating there in the radial direction, said tube section being under pretension, said tube expanding under pressure inside blind hole (86) of valve body (65), thus opening tube valve (64), and closing below a pressure that acts there or with an overpressure on its exterior. A shorter cylindrical connecting part (67) extends laterally from elongate cylindrical part (66) of valve body (65) in this lengthwise direction, said part increasing in radius outward with respect to cylindrical part (66) and thereby sloping at the transition to cylindrical part (66) with a surrounding stop surface that is aligned perpendicularly to the surface of cylindrical part (66) and serves as a stop for tube section (69) that fits over the entire length of cylindrical part (66).

Cylindrical part (67) is enlarged in diameter on the right external side, as a radially projecting surrounding flange projection (68), with a broad concentric contact surface formed on the right-hand exterior of valve body (65). This contact surface runs around the right-hand opening of blind hole (86) of valve body (65) as an external circular segment area. Blind hole (86) is then applied with a staggered inside diameter inside valve body (65), and then has a cylindrical section with a smaller diameter in the longer cylindrical part (66) and has a shorter cylindrical second section, with a larger inside diameter, inside part (67). Thus a locking receptacle is formed inside blind hole (86) on the right, in which receptacle a pump sleeve (71) with a plug-in connection (73) located centrally on the left-hand end face and tapering-in diameter can be fastened. Pump sleeve (71), laterally of plug-in connection (73), has a concentrically surrounding end face that abuts the external supporting surface that runs concentrically around the right-hand end of valve body (65) in the mounted state and fits against it in a positive and liquid-tight manner.

Valve body (65) with pump sleeve (71) mounted thereon is then pushed at the end of a pump rod (70) of piston slide pump (107) into a lateral right-hand opening. Pump rod (70) is then designed as a feed tube with a continuous lengthwise bore (122) and expands at the right-hand end to receive the valve body to a step-wise transitional concentric surrounding bearing bore for part (67) of the valve body that adjoins elongate freestanding cylindrical part (66) and has a larger outside diameter, against which part (67) plug-in connection (73) and external cylindrical part (72) of pump sleeve (71) are mounted.

Part (67) of valve body (65) makes a positive connection with this bearing bore, with a clamping fit of the desired strength being produced by means of surrounding locking ribs on the inner surfaces of the bearing bore of the pump rod.

Valve body (65) and pump sleeve (71) are then aligned in the axial direction of pump rod (70), with elongate cylindrical part (66) of valve body (65) supporting tube section

(69) projecting freely into the pump rod that is formed internally in a lengthwise direction as a feed tube and with part (67) of the valve body that has a larger external diameter holding the latter in the bearing bore at the end of pump rod (20).

To produce an optimum tube seat, elongate cylindrical part (66) is designed with different dimensions over its length. At the part (67) of valve body (65) that has a wider diameter and is likewise rotationally symmetrical, a section abuts, initially with steps, which has an outside diameter that is tapered with respect to a following middle section so that the thicker central section prevents the tube section from slipping off during the pumping process. In the end part of the tube seat, elongate cylindrical part (66) of valve body (65) tapers frustroconically, with radial valve openings (84, 85) located in this area for the contents of the pump to emerge.

Pump rod (70) thus has valve body (65) mounted on its right-hand end section and pump sleeve (71) is displaceable rightward in a pump barrel (76) into and from which the disinfectant and liquid surfactant products to be delivered can be drawn in or expelled by adjusting pump sleeve (71).

An actuating head (75) is permanently attached to the left-hand end of pump rod (70), said pump rod (70) being displaced in the lengthwise direction of pump barrel (76) when pressure is exerted rightward on the actuating head. This is accomplished by compression of a compression spring (78) tensioned between a stop surface (79) located on the right-hand end of actuating head (75) and a stop surface (77) formed on a left-hand extension of pump barrel (76) (see FIG. 16).

In this manner, the lateral right-hand part of pump rod (70) with valve body (65) mounted thereon and pump sleeve (71) can be moved within pump barrel (76) in the axial direction as a piston, with pump barrel (76) having a cylindrical internal chamber whose inside diameter remains constant within this adjustment range.

While pump rod (70) and valve body (65) have an outside diameter that is smaller than the inside diameter of the inside chamber in the adjustment range of the pump barrel, pump sleeve (71) expands laterally to the right of its cylindrical part (72) to form a radially projecting frustroconical section that abuts a concentric surrounding collar (82) on inside wall (83) of the interior of pump barrel (76).

The collar thus fits tightly, so that during the compression and suction strokes of piston slide pump (107) no liquid can escape between pump barrel (76) and pump rod (70) displaceably guided therein.

A check valve (103) is located in pump barrel (76) at the end of the adjustment range of pump sleeve (71), said valve, when pressure is applied to the interior of pump barrel (76), closing the latter by a closing body (80) that adjusts rightward into a valve seat (81), so that any liquid that is present cannot flow back into supply container (102), but is forced through the elongate opening of sleeve (71), blind hole (86), and radial valve openings (84, 85) of the valve body beneath tube section (69) that expands outward into lengthwise bore (122) of pump rod (70) and is thus expelled through outlet opening (104) provided in actuating head (75).

As soon as pump rod (70) is no longer being forced into pump barrel (76), the latter is forced outward by expanded tension spring (78) together with actuating head (75), so that a vacuum develops in the interior of pump barrel (76), and this vacuum together with the overpressure of the liquid inside supply container (102) that acts against atmospheric pressure displaces closing body (80) out of valve seat (81) and thus opens check valve (103).

Thus, new liquid passes from supply container (102) into the interior of pump barrel (76), with the pump barrel in each case receiving a definably adjustable metered amount, preferably 1–4 ml.

Pump sleeve (71) expands by its frustroconical collar (82) in the direction of check valve (103), guided up to inside wall (83) of the interior of pump barrel (76), in order to form a broad concentric surrounding sealing surface with the latter there. This outer seal and elastic tube section (69) drawn over radial valve openings (84, 85) on elongate cylindrical part (66) of the valve body ensure a considerable leaktightness of the piston slide pump so that the latter, even in a horizontal position with respect to the room wall when located in the lower area of supply container (102), withstands the hydrostatic pressure of the liquid acting within the supply container, even at a height of more than 20 cm.

Check valve (103) is located at the end of the adjustment range in the interior of pump barrel (76). Sealing body (80) made of an elastic plastic material has two centering plates (100) in its forward section, placed crosswise with respect to one another, said plates having a length such that they, during the entire actuation of the piston slide pump to center the sealing body that is displaced during the transition from the pressure stroke to the suction stroke, project through a central blocking opening (118) in valve seat (81), which opening is formed by a shoulder (120) concentrically surrounding and extending radially inward from inside wall (83), and being sealable by a central frustroconical sealing body section (101). At its left-hand outer end, sealing body (80) has a collar (109) extending from central sealing body section (101) and directed radially outward, said collar abutting a surrounding stop rib (121) that extends out from inside wall (83) at the transition from the suction stroke.

Collar (119) is provided with individual circularly arranged openings that open as soon as collar (119), which projects radially outward, is no longer pressed against the concentric surrounding radially projecting shoulder (120) of valve seat (81), which acts as a seal to close the openings of collar (119).

During the suction stroke, sealing body (80) contacts the surrounding stop rib (121) only by an outer edge of collar (119), said rib projecting only slightly radially, so that the openings in collar (119) remain open to allow liquid to flow from supply container (102) into the interior of pump barrel (76). The adjusting path of sealing body (80) is then relatively short.

FIG. 16 shows piston slide pump (107) according to FIG. 15 at the end of the suction stroke, with liquid being drawn through open valve seat (81) and the openings in collar (119) of sealing body (80) into the interior of pump barrel (76) by means of pump rod (70) retracted leftward by tension spring (78) in pump barrel (76) and with the outflow from lengthwise bore (122) through closed tube valve (64) being blocked. The liquid is then present inside pump sleeve (71) and tube valve (64) and is expressed during the compression stroke by the rightward movement of pump rod (70) and pump sleeve (71) over the adjustment range of pump barrel (76), through the hole in pump sleeve (71) and blind hole (86) of valve body (65) as well as radial valve openings (84, 85) below tube section (69) and then through pump rod (70), structured internally as a delivery tube with outflow line (122), to liquid outlet opening (104).

FIG. 16 merely shows the state of the liquid at the end of the suction stroke. Pump barrel (76) tapers laterally to the right of valve seat (81) of the check valve to a tube section where a tube is fastened that is guided directly into supply container (102) for the liquid, so the liquid enters this tube and tube section from the supply container. In the drawing in FIG. 16, actuating head (75) is shown in cross section in contrast to FIG. 15, with the position of compression spring (78) being shown between stop surface (77) at a left-hand extension of pump barrel (76) and stop surface (79), formed by actuating head (75). The design of outflow line (122) of pump rod (70) as a delivery tube is clearly evident, said rod making a transition at the left and downward in actuating head (75) to liquid outlet opening (104) through a downward-guided channel.

According to FIG. 17, pump barrel (76) rests for its entire length inside supply container (102), with a screw thread (88) being provided in which a screw cap (123) presses a stop, projecting radially on the outside of pump barrel (76) and running all the way around, against threaded stub (106) of supply container (102). The screw cap in the left-hand area has a circumferential tubular section (124) guided over tension spring (78) and coming to rest within hollow actuating head (75) at a distance from the end face, so that during the compression stroke, actuating head (75) is displaceable rightward over this tubular section against the screw cap on screw thread (88). By means of screw cap (123) designed as a union nut, the maximum displacement of pump rod (70) is simultaneously set at its left-hand outer position at the end of its suction stroke, with a stop (125) being provided in screw cap (123) against which a section of pump rod (70) with an enlarged outside diameter in the vicinity of inserted valve body (65) abuts laterally (see FIG. 15).

PREFERRED EMBODIMENT OF INVENTION

The preferred embodiment (133), shown in FIG. 17, of the dispenser for liquid disinfectants and liquid surfactant products has the piston slide pump (107) provided with a tube valve (64). Once again a cylindrical opening (36) is provided in the masonry as an elongate core-drilled hole into which a wall installation housing (110) of suitable shape can be installed, said housing being made of plastic and closed at the inner end by a rear end wall (87). and being mountable by means of two holes (98, 99) located in said wall. The cylindrical wall installation housing on the other hand is open over its entire cross section, so that supply container (102) of dispenser (133), made of plastic, can be inserted into wall installation housing (110). This anterior insertion opening (89) of wall installation housing (110) is closable by means of an external shield (105) which can be slid over a locking projection (90) of the wall installation housing, said projection being circumferential and extending above the masonry to the side of the core-drilled hole, with a retaining collar (108) projecting radially rightward. Retaining collar (108) has a locking rib (126) guided over a small angular segment, said locking rib being central and projecting inward from the underside, and being insertable into a recess (92) located externally in the circumferential direction of projecting locking projection (90) of wall installation housing (110). The recess opens forward beyond a certain angle range so that locking rib (126) projecting from retaining collar (108) is in the form of a bayonet lock and can be locked by inserting it with rotation into recess (92) that runs in the circumferential direction of core-drilled hole (36) (see opening (91) for the expansion of recess (92) to the front left.) From external shield (105) internally and centrally, at the level of supply container (102), a retaining cam (109) directed at the latter extends, said cam having a rib (111) extending transversely over its center. This rib (111) engages a lengthwise slot (112) abutted by a bearing cam (113) extending centrally outward from the forward end face of the supply container, in the direction of retaining cam (109). Since suitably dimensioned rib (111) of retaining cam (109) engages lengthwise slot (112) after mounting external shield. (105) on the projecting edge of wall installation housing (110), and rib (111) engages nonrotatably in bearing cam (113), and the supply container (102) is simultaneously rotated inside wall installation housing (110) with rotation of retaining collar (108) and guidance of locking rib (126) into recess (92) that extends over an angle section.

Since a recess (94) that opens to the left and is molded in the container wall is located in the right-hand section of the supply container, in the cylindrical outside wall (93) located there, extending a certain length from external right-hand end wall (87) of the supply container, into which recess a locking cam (96) projecting laterally inward from inside wall (97) of wall installation housing (110) fits when the supply container is inserted, whereupon with recess (94) makes a transition at its end to a locking groove (95) that is bent upward against the direction of rotation of supply container (102) at the forward end face of the wall installation housing, simultaneously with the locking of the bayonet connection of external shield (105) at the forward end face of the wall installation housing, the bayonet connection formed there locks at the end of the wall installation housing against the end of supply container (102) located there. By a single rotation of external shield (105), the front and rear bayonet connections are lockable or releasable in the wall installation housing. Locking cam (96) on inside wall (97) of wall installation housing (110) must then be at a distance from rear end face (87), with holes (98, 99) of the wall installation housing being such that when the wall installation housing is pushed in, locking cam (96) comes to rest at locking groove (95) and thus, upon rotation of supply container (102), is rotated from recess (94) into locking groove (95). Contact by locking groove (95) must then be provided at an angular position and depth on the outside wall of supply container (102) such that upon engagement of locking cam (96) in recess (94), external shield (105), which must be mounted opposite supply container (102) with locking rib (126) projecting from retaining collar (108), enters opening (91) of recess (92) on locking projection (90) of the wall installation housing and, upon rotation, locking cam (96) and locking rib (126) simultaneously grip one another.

Two circumferential guide beads (114, 115) located at a distance from one another are provided on the cylindrical outer jacket of supply container (102). These permit an optimum retention of supply container (102) within wall installation housing (110) (light clamp fit.) Guide bead (115) is then interrupted in the vicinity of recess (94).

Supply container (102) is made cylindrical, and has two flattened jacket surface areas that extend over the entire length of the supply container. These serve to guide the supply container when it is filled, so that on a conveyor belt, when the container is being filled with liquid, the outlet, which is not centrally located in the supply container, remains aligned in the preset position, so that the container does not rotate laterally on the conveyor belt.

Despite this flattened outside wall (93), assurance must be provided that supply container (102) can rotate in wall installation housing (110). Supply container (102) as well as wall installation housing (110) are made round in cross section to allow these parts to be inserted into the core-drilled hole or internally into the cylindrically shaped wall installation housing. The length of the core-drilled hole is then 10–15 cm. The parts of piston slide pump (107) can then be located up to actuating head (75), with outer screw cap (123) and its lateral tube section inside wall installation housing (110). The travel of the piston slide pump is then relatively short for the metering volume provided, so that the travel of pump rod (70) required between the screw cap and actuating head (75) is short. Hence, actuating head (75) projects forward only slightly together with the part of external shield (105) that bulges externally around it, over the wall area of the respective mounting area.

To vent supply container (102), an opening (116) is provided at its upper left front end face, in which opening a vent valve (117) is fitted that opens when there is a vacuum in the supply container. It consists of two sealing pieces (127, 128) that extend internally from an annular valve opening and are spring-loaded against one another, said pieces abutting one another like the upper and lower parts of a duck's bill (duckbill valve.)

This vent valve means that the supply container is vented behind piston slide pump (107) designed as a tube valve pump. Instead of the German expression "Entenschnabelventil," the expression "DUCK-BILL" is conventionally employed. This vent valve (117) is inserted into opening (116) in such fashion that the valve projects inward like a bill, so that when there is pressure in the supply container a force is exerted from above and below on flap-shaped sealing pieces (127, 128) of the valve, and they are pressed together until a vacuum in the supply container or an overpressure outside the container causes the sealing pieces to move away from one another again. Vent valve (117) thus simultaneously provides protection against external contamination, pests, and drying out of the liquid contents.

Dispenser (133) also has, in addition to piston slide pump (107) shown in FIGS. 15 and 16, the pump drive (129) shown there and consists of actuating head (75) mounted displaceably lengthwise, pump rod (70), and compression spring (78), each of which is mounted with its end against stop surface (77, 79) and thus, after compression by rightward displacement of actuating head (75) and pump rod (70), again displaces these parts leftward after the actuating head is released. A pump unit (131) is thus formed that corresponds to pump unit (6) in dispenser (1), said pump unit (6) consisting of pump drive (9) and piston slide pump (7), said pump unit (131) consisting of pump drive (129) and piston slide pump (107) and is therefore secured by screw connection (88) against the wall installation housing or the supply container instead of being held by screwing against sealing plate (27).

Pump unit (131) is located horizontally on the container bottom, with a piston slide pump (107) having a tube valve being leak-tight in this position. It thus comes to rest, except for pump barrel (76) which is slid into supply container (102) and its threaded stub (106) and thus forms, together with the latter, forms the part of the dispenser that is slid into wall installation housing (110) (installation element (130)), outside said section and below dispenser head (132) that is molded in external shield (105) and projecting therefrom.

| List of Reference Numerals | |
|---|---|
| Dispenser | 1 |
| Supply container | 2,3 |
| Liquid outlet opening | 4 |
| External shield | 5 |
| Pump unit consisting of metering pump and mechanical drive | 6 |
| Metering pump designed as a piston slide pump | 7 |

-continued

| List of Reference Numerals | |
|---|---|
| Pump housing of piston slide pump (7) | 8 |
| Mechanical drive for piston slide pump (7) | 9 |
| Wall installation housing | 10 |
| Installation element or portion of dispenser | 11 |
| Sealing ring | 12 |
| Open end face of wall installation housing | 13 |
| Dispensing head | 14 |
| External long side of supply container (3) | 15 |
| External long side of supply container (2) | 16 |
| Inside wall of wall installation housing | 17 |
| Lengthwise sliding guide of supply container in wall installation housing | 18 |
| Lengthwise rib made as a guide rail for wall installation housing | 19a,b |
| Circular metal bands or cuffs of wall installation housing | 21,22 |
| — | 23 |
| Claw lock | 24 |
| Outer tabs of wall installation housing | 25 |
| Cylindrical receptacle for wall installation housing | 26 |
| Sealing plate | 27 |
| Support plate to the side of sealing plate | 28 |
| Additional connecting ribs and sections of wall installation housing | 29,30 |
| Outlet stub of upper supply container (3) | 31 |
| Inlet opening of lower supply container (2) | 32 |
| Container bottom | 33 |
| Liquid outlet | 34 |
| Adapter unit | 35 |
| Installation opening | 36 |
| Pushbutton | 37 |
| Piston | 38 |
| Metering cylinder | 39 |
| Elongate hole in sealing plate (27) | 40 |
| Connecting hole at feed to metering cylinder | 41 |
| Check valve | 42 |
| Adapter unit | 43 |
| Connecting channel | 44 |
| Overpressure valve | 45 |
| Prechamber | 46 |
| Adjusting slide | 47 |
| Locking openings on inside wall of wall installation housing | 48,49 |
| Locking element | 50 |
| Locking claws on locking element mounted on sealing plate (27) | 51,52 |
| Central projection on locking element (50) | 53 |
| — | 54 |
| Front surface of sealing plate (27) | 55 |
| Intermediate piece between sealing plate and metering cylinder (39) of sealing plate (27) | 56 |
| — | 57 |
| Bent edge piece of external shield (5) | 58 |
| Projecting stub of external shield (5) | 59 |
| Circular opening in dispensing head | 60 |
| Opening slot on underside of outer shield (5) | 61 |
| Retaining rib for mounting locking element (50) | 62 |
| Plug | 63 |
| Tube valve | 64 |
| Valve body | 65 |
| Elongate cylindrical part of tapered valve body | 66 |
| Adjoining stepped part of valve body with greater diameter | 67 |
| Annular flange projection in part (67) | 68 |
| Tube section | 69 |
| Pump rod | 70 |
| Pump sleeve | 71 |
| Cylindrical part of pump sleeve | 72 |
| Tapered tubular plug connection of pump sleeve | 73 |
| End of pump rod | 74 |
| Actuating head | 75 |
| Pump barrel | 76 |
| Stop surface | 77 |
| Compression spring | 78 |
| Stop surface | 79 |
| Sealing body | 80 |

-continued

| List of Reference Numerals | |
|---|---|
| Valve seat | 81 |
| Collar | 82 |
| Inside wall of pump barrel | 83 |
| Radical cylindrical part of valve body | 84,85 |
| Axial blind hole in valve body | 86 |
| Rear end wall | 87 |
| Screw thread | 88 |
| Insertion opening | 89 |
| Locking projection | 90 |
| Opening | 91 |
| Recess on end face of wall installation housing | 92 |
| Outside wall of supply container (102) | 93 |
| Recess in outside wall (93) | 94 |
| Locking groove | 95 |
| Locking cam | 96 |
| Inside wall of wall installation housing | 97 |
| Mounting holes on rear end wall | 98,99 |
| Centering plates of sealing body (80) | 100 |
| Central locking body section | 101 |
| Supply container | 102 |
| Check valve | 103 |
| Liquid outlet opening | 104 |
| External shield | 105 |
| Threaded stub | 106 |
| Piston slide pump with tube valve | 107 |
| Retaining collar of external shield | 108 |
| Internal retaining cam | 109 |
| Wall installation housing | 110 |
| Ribs of retaining cam (109) | 111 |
| Lengthwise slot | 112 |
| Bearing cam | 113 |
| Guide bead | 114,115 |
| Opening | 116 |
| Vent valve (duckbill valve) | 117 |
| Blocking opening | 118 |
| Collar | 119 |
| Shoulder blocking opening | 120 |
| Stop rib | 121 |
| Lengthwise bore | 122 |
| Screw cap | 123 |
| Tubular section | 124 |
| Stop for pump rod | 125 |
| Locking rib | 126 |

-continued

| List of Reference Numerals | |
|---|---|
| Sealing pieces of duckbill valve | 127,128 |
| Pump drive | 129 |
| Installation element | 130 |
| Pump unit | 131 |
| Dispensing head | 132 |
| Dispenser | 133 |

I claim:

1. Dispenser for liquid, comprising one supply container having a liquid outlet opening, a pump unit located between a lower liquid outlet of the one supply container, the lower liquid outlet being provided adjacent a bottom of the one supply container, and the liquid outlet opening, the pump unit extending substantially horizontally from the lower liquid outlet of the one supply container in the vicinity of the bottom of the one supply container, a housing part receiving said supply container, the dispenser being designed as a module that can be inserted into a wall installation opening, wherein the housing part is designed as an elongate wall installation housing in the form of a hollow cylinder, and the supply container, the pump unit and the liquid outlet opening form an elongate module having an outer section formed by an external shield having a dispensing head projecting axially outward therefrom, in which head the liquid outlet opening, an outer actuating element for the pump unit consisting of a metering pump, a mechanical pump drive and an overpressure valve that blocks the liquid outlet opening at normal pressure are provided, said module being so dimensioned that a section up to the outer section defining an installation element can pass through an open end of the wall installation housing and can be inserted into and removed from said wall installation housing, wherein the installation element can be fastened from the outside to the wall installation housing by releasable connecting means.

* * * * *